US009644846B2

(12) United States Patent
Stevenson et al.

(10) Patent No.: US 9,644,846 B2
(45) Date of Patent: May 9, 2017

(54) SYSTEMS AND METHODS FOR CONTROL OF COMBUSTION DYNAMICS AND MODAL COUPLING IN GAS TURBINE ENGINE

(71) Applicant: General Electric Company, Schenectady, NY (US)

(72) Inventors: Christian Xavier Stevenson, Blanchester, OH (US); Sarah Lori Crothers, Greenville, SC (US)

(73) Assignee: General Electric Company, Schenectady, NY (US)

( * ) Notice: Subject to any disclaimer, the term of this patent is extended or adjusted under 35 U.S.C. 154(b) by 431 days.

(21) Appl. No.: 14/248,194

(22) Filed: Apr. 8, 2014

(65) Prior Publication Data

US 2015/0285505 A1 Oct. 8, 2015

(51) Int. Cl.

| | |
|---|---|
| ***F23R 3/34*** | (2006.01) |
| ***F23M 20/00*** | (2014.01) |
| ***F23R 3/28*** | (2006.01) |

(52) U.S. Cl.

CPC ..... *F23R 3/34* (2013.01); *F23M 20/005* (2015.01); *F23R 3/286* (2013.01);

(Continued)

(58) Field of Classification Search

CPC ..... F23M 20/005; F23R 3/286; F23R 3/34; F23R 3/28; F23R 2900/00013;

(Continued)

(56) References Cited

U.S. PATENT DOCUMENTS

| | | | | |
|---|---|---|---|---|
| 2,072,826 A | | 3/1937 | Riley | |
| 3,817,681 A | * | 6/1974 | Haag | F23C 15/00 431/1 |

(Continued)

FOREIGN PATENT DOCUMENTS

| | | |
|---|---|---|
| EP | 1605205 | 12/2005 |
| EP | 1632718 | 3/2006 |

(Continued)

OTHER PUBLICATIONS

Richards, Geo et al., "Effect of Fuel System Impedance Mismatch on Combustion Dynamics," ASME Turbo Expo 2005: Power for Land, Sea, and Air, vol. 2, Paper No. GT2005-68386, Reno, Nevada, Jun. 6-9, 2005, 11 pgs.

(Continued)

*Primary Examiner* — Gerald L Sung
*Assistant Examiner* — Alain Chau
(74) *Attorney, Agent, or Firm* — Charlotte C. Wilson; Ernest G. Cusick; Frank A. Landgraff

(57) ABSTRACT

A gas turbine engine system including a first combustor having a first fuel nozzle and a second combustor having a second fuel nozzle. The system further includes a first acoustic adjuster having a first drive coupled to a first piston with a first fuel orifice. The first piston is disposed along a first fuel passage leading to the first fuel nozzle of the first combustor. The system further includes a second acoustic adjuster having a second drive coupled to a second piston with a second fuel orifice. The second piston is disposed along a second fuel passage leading to the second fuel nozzle of the second combustor.

17 Claims, 7 Drawing Sheets

(52) U.S. Cl.
CPC ..... *F05D 2260/964* (2013.01); *F23R 2900/00013* (2013.01); *F23R 2900/03342* (2013.01)

(58) Field of Classification Search
CPC ..... F23R 2900/03342; F05D 2260/96; F05D 2260/962; F05D 2260/964; F23C 15/00
See application file for complete search history.

(56) References Cited

U.S. PATENT DOCUMENTS 4,044,553 A 8/1977 Vaught
4,620,414 A 11/1986 Christ
4,677,822 A 7/1987 Iizuka et al.
4,724,670 A 2/1988 Greer
4,901,694 A 2/1990 Sakita
5,159,807 A 11/1992 Forestier
5,211,004 A 5/1993 Black
5,319,931 A 6/1994 Beebe et al.
5,345,758 A 9/1994 Bussing
5,575,144 A * 11/1996 Brough ..... F23R 3/26 431/114
5,657,631 A 8/1997 Androsov
5,809,769 A * 9/1998 Richards ..... F23N 5/16 431/114
5,943,866 A 8/1999 Lovett et al.
6,164,055 A 12/2000 Lovett et al.
6,625,569 B2 9/2003 James et al.
6,820,431 B2 11/2004 McManus et al.
7,278,266 B2 8/2007 Taware et al.
7,320,222 B2 * 1/2008 Flohr ..... F23R 3/14 431/114
7,331,182 B2 * 2/2008 Graf ..... F23M 20/005 181/213
7,337,057 B2 2/2008 Norman et al.
7,451,601 B2 11/2008 Taware et al.
7,503,177 B2 3/2009 Bland et al.
7,523,614 B2 4/2009 Tanimura et al.
7,578,130 B1 8/2009 Kraemer et al.
7,620,461 B2 11/2009 Frederick, II et al.
7,693,147 B2 4/2010 Williams et al.
7,739,999 B2 6/2010 Kang et al.
7,743,599 B2 6/2010 Taware et al.
7,805,922 B2 10/2010 Bland
7,886,545 B2 2/2011 Lacy et al.
7,908,072 B2 3/2011 Tonno et al.
7,997,083 B2 8/2011 Meadows et al.
8,112,216 B2 2/2012 Davis, Jr. et al.
8,113,000 B2 2/2012 Laster et al.
8,322,140 B2 12/2012 Kim et al.
8,966,909 B2 3/2015 Crothers et al.
9,027,349 B2 5/2015 Miura et al.
2003/0144787 A1 7/2003 Davis, Jr. et al.
2004/0083738 A1 5/2004 McManus et al.
2005/0278108 A1 12/2005 Norman et al.
2006/0041368 A1 2/2006 Williams et al.
2006/0042261 A1 3/2006 Taware et al.
2006/0107666 A1 5/2006 Kothnur
2006/0254279 A1 11/2006 Taware et al.
2007/0180831 A1 8/2007 Bland
2007/0199328 A1 8/2007 Shah et al.
2008/0010966 A1 1/2008 Taware et al.
2009/0005951 A1 1/2009 Frederick et al.
2009/0005952 A1 1/2009 Tonno et al.
2009/0063003 A1 3/2009 Meadows et al.
2009/0320483 A1 12/2009 Storey et al.
2010/0170254 A1 7/2010 Venkataraman et al.
2010/0192578 A1 8/2010 Singh et al.
2010/0232930 A1 9/2010 Gregory
2010/0236214 A1 * 9/2010 Wiedenhoefer ..... F23R 7/00 60/39.39
2010/0313568 A1 12/2010 Davis, Jr. et al.
2011/0048021 A1 * 3/2011 Slobodyanskiy ..... F01D 9/023 60/725
2011/0072826 A1 3/2011 Narra et al.
2011/0162370 A1 7/2011 Kim et al.
2011/0179795 A1 7/2011 Johnson et al.
2011/0308654 A1 * 12/2011 Bothien ..... F23M 99/005 138/31
2012/0006029 A1 1/2012 Bilbao et al.
2012/0131923 A1 5/2012 ELKady et al.
2012/0144832 A1 6/2012 Herbon et al.
2013/0000312 A1 1/2013 Kodukulla et al.
2013/0014514 A1 1/2013 Romig et al.
2014/0053528 A1 2/2014 Crothers et al.
2014/0060063 A1 3/2014 Boardman et al.
2014/0109587 A1 4/2014 Crothers et al.
2014/0137561 A1 5/2014 Crothers et al.
2014/0238026 A1 8/2014 Boardman et al.
2014/0238033 A1 8/2014 Crothers et al.
2014/0238041 A1 8/2014 Crothers et al.
2014/0260299 A1 9/2014 Boardman et al.
2014/0338341 A1 11/2014 Abreu
2015/0219337 A1 8/2015 Crothers et al.
2015/0260407 A1 9/2015 Crothers et al.
2015/0285508 A1 10/2015 Olson

FOREIGN PATENT DOCUMENTS

EP 2031192 3/2009
JP 2009281720 A 12/2009
JP 2012102733 A 5/2012

OTHER PUBLICATIONS

Spoor et al., "Mode-locking of acoustic resonators and its application to vibration cancellation in acoustic heat engines," Condensed Matter and Thermal Physics Group, Los Alamos National Laboratory, Los Alamos, New Mexico, Feb. 10, 1999, 10 pgs.
U.S. Appl. No. 14/276,700, filed May 13, 2014, Crothers et al.
U.S. Appl. No. 14/249,158, filed Apr. 9, 2014, Ziminsky et al.
U.S. Appl. No. 14/288,875, filed May 28, 2014, Crothers et al.
U.S. Appl. No. 14/288,974, filed May 28, 2014, Crothers et al.
U.S. Appl. No. 14/316,616, filed Jun. 26, 2014, Crothers et al.
U.S. Appl. No. 14/659,399, filed Mar. 16, 2015, DiCintio et al.
U.S. Appl. No. 14/248,194, filed Apr. 8, 2014, Stevenson et al.
U.S. Appl. No. 14/171,001, filed Feb. 3, 2014, Crothers et al.
U.S. Appl. No. 14/192,687, filed Feb. 27, 2014, Crothers et al.
U.S. Appl. No. 14/207,041, filed Mar. 12, 2014, Crothers et al.
U.S. Appl. No. 14/048,252, filed Oct. 8, 2013, Crothers et al.
U.S. Appl. No. 14/170,702, filed Feb. 3, 2014, Day et al.
U.S. Appl. No. 14/170,710, filed Feb. 3, 2014, Carnell Jr. et al.
U.S. Appl. No. 14/170,716, filed Feb. 3, 2014, Crothers et al.
U.S. Appl. No. 14/170,729, filed Feb. 3, 2014, Crothers et al.
U.S. Appl. No. 14/170,738, filed Feb. 3, 2014, Crothers et al.
U.S. Appl. No. 14/154,925, filed Jan. 14, 2014, Aphale et al.

* cited by examiner

SYSTEMS AND METHODS FOR CONTROL OF COMBUSTION DYNAMICS AND MODAL COUPLING IN GAS TURBINE ENGINE

BACKGROUND

The subject matter disclosed herein relates generally to gas turbine systems, and more particularly to systems and methods for controlling combustion dynamics, and more specifically, for reducing modal coupling of combustion dynamics.

Gas turbine systems generally include a gas turbine engine having a compressor section, a combustor section, and a turbine section. The combustor section may include one or more combustors (e.g., combustion cans) with fuel nozzles configured to inject a fuel and an oxidant (e.g., air) into a combustion chamber within each combustor. In each combustor, a mixture of the fuel and oxidant combusts to generate hot combustion gases, which then flow into and drive one or more turbine stages in the turbine section. Each combustor may generate combustion dynamics, which occur when the combustor acoustic oscillations interact with the flame dynamics (also known as the oscillating component of the heat release), to result in a self-sustaining pressure oscillation in the combustor. A key contributor to combustion dynamics is the acoustic response of the fuel system, commonly defined as the fuel system impedance, or fuel system acoustic impedance. Combustion dynamics can occur at multiple discrete frequencies or across a range of frequencies, and can travel both upstream and downstream relative to the respective combustor. For example, the pressure waves may travel downstream into the turbine section, e.g., through one or more turbine stages, or upstream into the fuel system.

Certain downstream components of the turbine system can potentially respond to the combustion dynamics, particularly if the combustion dynamics generated by the individual combustors exhibit an in-phase and coherent relationship with each other, and have frequencies at or near the natural or resonant frequencies of the components. For the purpose of this invention, "coherence" refers to the strength of the linear relationship between two dynamic signals, and is strongly influenced by the degree of frequency overlap between them. In the context of combustion dynamics, "coherence" is a measure of the modal coupling, or combustor-to-combustor acoustic interaction, exhibited by the combustion system. Accordingly, a need exists to control the combustion dynamics, and/or modal coupling of the combustion dynamics to reduce the possibility of any unwanted sympathetic vibratory response (e.g., resonant behavior) of components in the turbine system.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a gas turbine engine including a first combustor having a first fuel nozzle and a second combustor having a second fuel nozzle. The system further includes a first acoustic adjuster having a first drive coupled to a first piston with a first fuel orifice. The first piston is disposed along a first fuel passage leading to the first fuel nozzle of the first combustor. The system further includes a second acoustic adjuster having a second drive coupled to a second piston with a second fuel orifice. The second piston is disposed along a second fuel passage leading to the second fuel nozzle of the second combustor.

In a second embodiment, a system includes a first combustor having a first fuel nozzle with a first fuel post-orifice, and a second fuel nozzle with a second fuel post-orifice. The system further includes a first acoustic adjuster having a first drive coupled to a first piston with a first fuel pre-orifice. The first piston is disposed along a first fuel passage leading to the first fuel post-orifice. The system also includes a second acoustic adjuster having a second drive coupled to a second piston with a second fuel pre-orifice. The second piston is disposed along a second fuel passage leading to the second fuel post-orifice.

In a third embodiment, a system includes a gas turbine engine having a first fuel nozzle comprising a first fuel post-orifice. The system also includes a first acoustic adjuster having a first drive coupled to a first piston with a first fuel pre-orifice. The first piston is disposed along a first fuel passage leading to the first fuel post-orifice of the first fuel nozzle.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
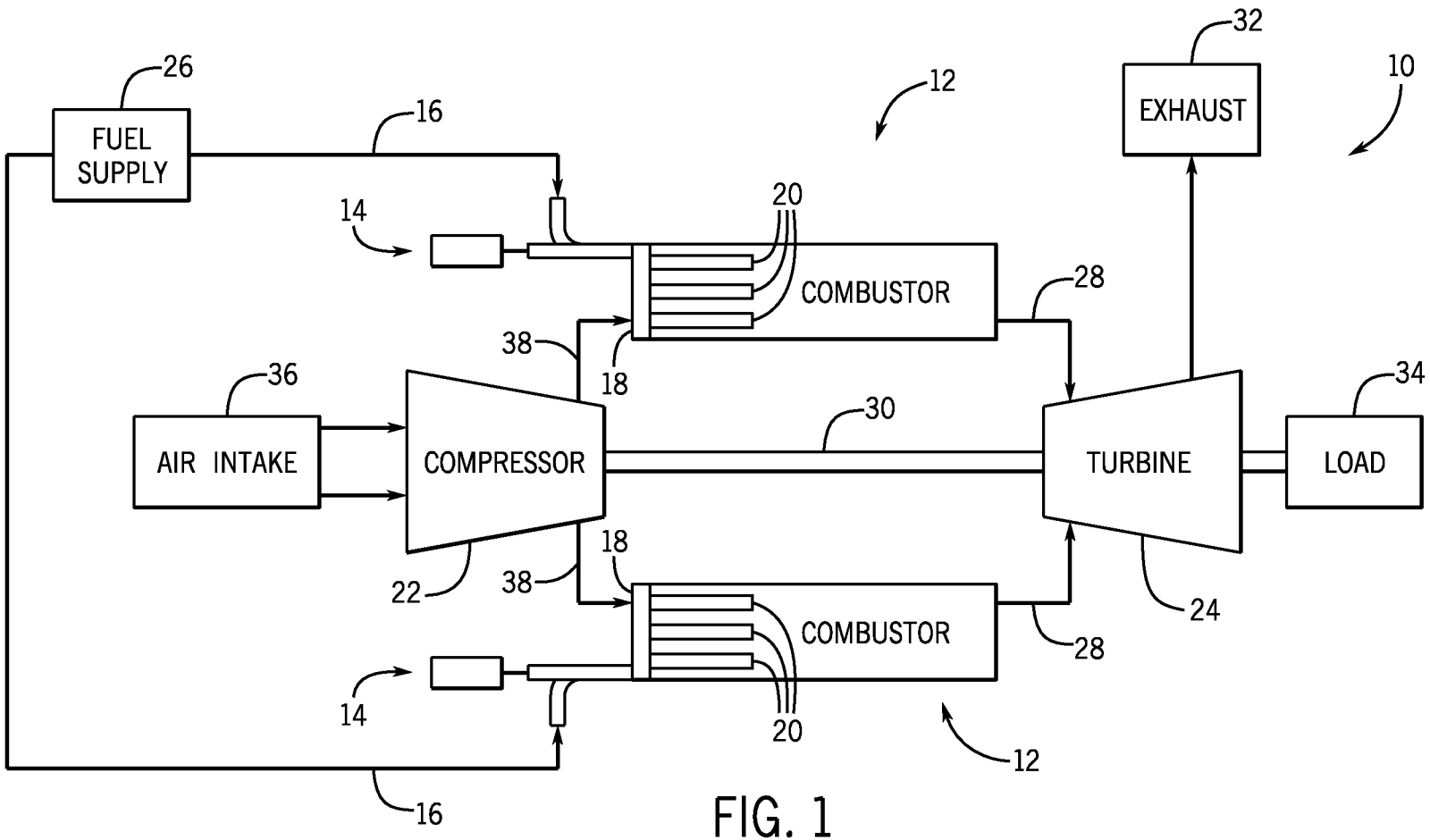
FIG. 1 is a schematic of an embodiment of a gas turbine system having a plurality of combustors, wherein each combustor is equipped with a fuel system acoustic impedance adjuster system configured to control combustion dynamics and/or modal coupling of combustion dynamics to reduce the possibility of unwanted vibratory responses in downstream components.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed towards reducing combustion dynamics and/or modal coupling of combustion dynamics, to reduce unwanted vibratory responses in downstream components of a gas turbine system. A gas turbine combustor (or combustor assembly) may generate combustion dynamics due to the combustion process, characteristics of intake fluid flows (e.g., fuel, oxidant, diluent, etc.) into the combustor, and various other factors. The combustion dynamics may be characterized as pressure fluctuations, pulsations, oscillations, and/or waves at certain frequencies. The fluid flow characteristics may include velocity, pressure, fluctuations in velocity and/or pressure, variations in flow paths (e.g., turns, shapes, interruptions, etc.), or any combination thereof. Collectively, the combustion dynamics can potentially cause vibratory responses and/or resonant behavior in various components upstream and/or downstream from the combustor. For example, the combustion dynamics (e.g., at certain frequencies, ranges of frequencies, amplitudes, combustor-to-combustor phases, etc.) can travel both upstream and downstream in the gas turbine system. If the gas turbine combustors, upstream components, and/or downstream components have natural or resonant frequencies that are driven by these pressure fluctuations (i.e. combustion dynamics), then the pressure fluctuations can potentially cause vibration, stress, fatigue, etc. The components may include combustor liners, combustor flow sleeves, combustor caps, fuel nozzles, turbine nozzles, turbine blades, turbine shrouds, turbine wheels, bearings, fuel supply assemblies, or any combination thereof. The downstream components are of specific interest, as they are more sensitive to combustion tones that are in-phase and coherent. Thus, reducing coherence specifically reduces the possibility of unwanted vibrations in downstream components. One way to reduce the coherence of the combustion dynamics among the combustors is to alter the frequency relationship between two or more combustors, diminishing any combustor-to-combustor coupling. As the combustion dynamics frequency in one combustor is driven away from that of the other combustors, modal coupling of combustion dynamics is reduced, which, in turn, reduces the ability of the combustor tone to cause a vibratory response in downstream components. An alternate method of reducing modal coupling is to reduce the constructive interference of the fuel nozzles within the same combustor, by introduction of a phase delay between the fuel nozzles, reducing the amplitudes in each combustor, and preventing or reducing combustor-to-combustor coupling. Furthermore, introducing a phase lag between the combustors, or otherwise altering the phase relationship between two or more combustors may also help to prevent or reduce modal coupling of the combustion dynamics.

The disclosed embodiments help to reduce unwanted vibratory responses associated with combustion dynamics by providing one or more fuel system acoustic impedance adjusters configured to adjust the fuel system acoustic impedance (magnitude and phase) of the fuel nozzles. The fuel system acoustic impedance of the fuel nozzles is defined by the geometry of the pre-orifice, the geometry of the post-orifice and the volume between the pre and post-orifice. Specifically, the fuel system acoustic impedance adjuster is a pneumatically or mechanically controlled device disposed along one or more fuel lines (e.g., fuel passages) upstream of the fuel nozzles and/or fuel injectors of the gas turbine system. In certain embodiments, each fuel system acoustic impedance adjuster incorporates a movable plunger system and an internal rotating disk system configured to adjust the geometry of the pre-orifice and/or the volume between the pre and post orifice, to adjust the fuel system acoustic impedance of one or more of the fuel nozzles. For example, the movable plunger system may be driven by any type of actuator (e.g., pneumatic, electromechanical, hydraulic, etc.) to allow in-situ adjustments within the acoustic adjuster. For example, the fuel system acoustic impedance may be adjusted by increasing or decreasing the length between a pre-orifice and a post-orifice, which in turn may increase or decrease the acoustic volume of the fuel plenum situated between the pre and post-orifice, which impacts both the phase and the magnitude of the fuel system acoustic impedance. Further, the internal rotating disk system may also affect the fuel system acoustic impedance by adjusting the interference pattern between two or more perforated plates of the disk system, thereby altering the geometry of the pre-orifice. The interference pattern may be adjusted by rotating a central perforated plate between the perforated plates of the disk system to change the cross-sectional area of one or more channels through the rotational disk system created by one or more orifices on the plates. Therefore, adjusting the interference pattern of the perforated plates varies the fuel system acoustic impedance. The plates may include a plurality of orifices with one or more geometric characteristics (e.g., size, shape, pattern, arrangement, positions, etc.).

In certain embodiments, varying various geometries of the fuel system acoustic impedance adjuster as described above may result in changes to the fuel system acoustic impedance that may lead to combustion dynamics frequencies in one or more combustors that are different, phase shifted, smeared or spread out over a greater frequency range, or any combination thereof, relative to any resonant frequencies of the components in the gas turbine system, and/or the combustion dynamics of one or more of the other combustors in the gas turbine system. By adjusting the fuel system acoustic impedance adjustor for a specific fuel nozzle, the magnitude and phase of the fuel system impedance for the fuel nozzle will be changed, which affects the fluctuating component of the heat release, and therefore the combustion dynamics of the combustor. Varying the fuel system impedance between two or more fuel nozzles within a combustor, results in different fuel system impedance magnitudes and phases for the different fuel nozzles, causing a phase delay from nozzle to nozzle and therefore, destructive interference among the fuel nozzles in the heat release zone, reducing the amplitude of the combustion dynamics, and potentially smearing the frequency content of the combustion dynamics across a broader frequency range. In addition to modifications on a combustor level (i.e., individual combustor), the disclosed embodiments may vary fuel system acoustic impedance adjuster geometries among a plurality of gas turbine combustors, thereby varying the fuel system acoustic impedance and therefore, combustion dynamics, from combustor to combustor in a manner to reduce the combustion dynamics amplitudes and/or modal coupling of the combustion dynamics among the plurality of gas turbine combustors. For example, each fuel system acoustic impedance adjuster configuration may result in combustor to combustor variations in the combustion dynamics frequency of the combustor, which is expected to reduce coherence. In addition, each fuel system acoustic impedance adjuster may result in, instead of, or in addition to, possible shifts in combustor-to-combustor phase, thereby reducing the possibility of modal coupling of the combustors, particularly at frequencies that are aligned with resonant frequencies of the components of the gas turbine system.

In some embodiments, each fuel system acoustic impedance adjuster may be disposed along a fuel line upstream of the head end (e.g., endcover) of the gas turbine. For example, in some embodiments, each fuel system acoustic impedance adjuster may be associated with a fuel nozzle (e.g., primary fuel nozzles and/or secondary fuel nozzles) of the gas turbine system. In some embodiments, each fuel system acoustic impedance adjuster may be associated with a fuel circuit (e.g., primary fuel circuit, secondary fuel circuit, fuel circuits routing different types of fuel such as liquid or gas fuels, etc.), where each fuel circuit may lead to one or more fuel nozzles. In particular, the disclosed embodiments relate to adjusting the components of the fuel system acoustic impedance adjuster (e.g., the moveable plunger system and/or the rotating disk system) to help vary the vibratory resonant response within the gas turbine system. For example, the movable plunger system within a particular fuel system acoustic impedance adjuster may be varied (e.g., vary the size of the plenum chamber to vary the volume of the fuel plenum between the pre and post orifice by varying the distance between a pre-orifice and a post-orifice, etc.) relative to the moveable plunger systems within other fuel system acoustic impedance adjusters of the gas turbine system. Additionally, the rotating disk system within a particular acoustic adjuster may be varied (e.g., adjusting the geometric characteristics of the rotating disk system to vary the fuel system acoustic impedance of one or more fuel nozzles, by varying the interference pattern of the orifices through the plates) relative to the rotating disk systems of other fuel system acoustic impedance adjusters within the gas turbine system, e.g., within a particular combustor or between different combustors.

Accordingly, the disclosed embodiments include one or more acoustic adjusters within the gas turbine system configured to control the fuel system impedance of one or more fuel nozzles in one or more combustors. In particular, the acoustic adjusters may be disposed along each fuel line or fuel circuit upstream of a head end (e.g., endcover) of the combustor. In such embodiments, varying the characteristics of the fuel plenum (e.g., volume, acoustic characteristics, etc.) of each combustor assembly may reduce combustion dynamics amplitudes, and/or alter the frequency of the combustion dynamics within a single combustor assembly. Further, varying the characteristics of the fuel plenum (e.g., volume, acoustic characteristics, etc.) of one or more combustor assemblies may reduce modal coupling of the combustors, and therefore reduce unwanted vibratory responses in downstream components.

With the forgoing in mind, FIG. 1 is a schematic of an embodiment of a gas turbine system 10 having a plurality of combustors 12, wherein each combustor 12 is equipped with a fuel system acoustic impedance adjuster 14 (e.g., acoustic adjuster 14). In the illustrated embodiment, each combustor 12 is associated with one or more acoustic adjusters 14, which may be disposed along a fuel line 16 upstream of the respective combustor 12 (e.g., upstream of an endcover 18 and one or more fuel nozzles 20). As discussed in detail below, each acoustic adjuster 14 may be configured to adjust the fuel system acoustic impedance of the fuel nozzles 20 by varying the geometry of various components of the acoustic adjuster 14. For example, each acoustic adjuster 14 may vary the geometry of the pre-orifice, and/or the volume between the pre-orifice and post-orifice. As noted above, varying various geometries of the acoustic adjuster 14 as described above may adjust the fuel system acoustic impedance of one or more of the fuel nozzles, thereby that may lead to a shift in combustion dynamics frequency and/or greater variations in the frequency content of the resulting combustion dynamics. In some embodiments, each combustor 12 may be associated with one acoustic adjuster 14. In other embodiments, each combustor 12 may be associated with two or more acoustic adjusters 14, e.g., 3, 4, 5, 6, 7, 8, 9, 10, or more.

The gas turbine system 10 includes the one or more combustors 12 (e.g., 1, 2, 3, 4, 5, 6, 7, 8, 9, 10, or more combustors) having the one or more acoustic adjusters 14 disposed along one or more fuel lines 16. The gas turbine system 10 also has a compressor 22 and a turbine 24. The combustors 12 may include fuel nozzles 20 that route a fuel 26 (e.g., liquid fuel and/or a gas fuel, a first fuel, etc.) into the combustors 12 for combustion within a combustion chamber. The combustors 12 ignite and combust a fuel/air mixture to generate hot combustion gases 28. The hot combustion gases 28 are passed into the turbine 24. The turbine 24 includes turbine blades that are coupled to a shaft 30, which is also coupled to several other components throughout the system 10. As the combustion gases 28 pass between and against the turbine blades in the turbine 24, the turbine 24 is driven into rotation, which causes the shaft 30 to rotate. In some embodiments, the combustion dynamics can potentially cause vibratory responses and/or resonant behavior in various components upstream and/or downstream from the combustor. For example, the combustion dynamics (e.g., at certain frequencies, ranges of frequencies, amplitudes, combustor-to-combustor phases, etc.) can travel both upstream and downstream in the gas turbine system. The downstream turbine components are of specific interest, as they are more sensitive to combustion tones that are in-phase and coherent. Eventually, the combustion gases 28 exit the turbine system 10 via an exhaust outlet 32. Further, the shaft 30 may be coupled to a load 34, which is powered via rotation of the shaft 30. For example, the load 34 may be any suitable device that may generate power via the rotational output of the turbine system 10, such as an external mechanical load. For instance, the load 34 may include an electrical generator, a propeller of an airplane, and so forth.

In an embodiment of the turbine system 10, compressor blades are included as components of the compressor 22. The blades within the compressor 22 are coupled to the shaft 30, and will rotate as the shaft 30 is driven to rotate by the turbine 24, as described above. The rotation of the blades within the compressor 22 compress air from an air intake 36 into pressurized air 38. The pressurized air 38 is then fed into the fuel nozzles 20 of the combustors 12. The fuel nozzles 20 mix the pressurized air 38 and the fuel 26 to produce a suitable mixture ratio for combustion (e.g., a combustion that causes the fuel to more completely burn) so as not to waste fuel or cause excess emissions.

In the disclosed embodiments, the acoustic adjuster 14 may be configured to vary the fuel system acoustic impedance of the fuel nozzles 20 of the combustor 12, thereby leading to combustion dynamics frequencies in one or more combustors 12 that are different, phase shifted, smeared or spread out over a greater frequency range, or any combination thereof, relative to any resonant frequencies of the components in the system 10, and/or the combustion dynamics of one or more of the other combustors in the gas turbine system. For example, the acoustic adjuster 14 may include several system components that are adjustable, such as a movable plunger system and a rotational disk system (depicted in FIGS. 2, 5, 7). The moveable plunger system may be configured to change the volume of the fuel plenum between a pre-orifice and a post-orifice of one or more fuel nozzles in the combustor 12 (e.g., vary the size of the plenum chamber to vary the volume of the fuel plenum between the pre and post orifice by varying the distance between a pre-orifice and a post-orifice, etc.), while the rotational disk system may be configured to adjust the geometric characteristics of the rotating disk system to vary the fuel system acoustic impedance of one or more fuel nozzles, by varying the interference pattern of the orifices through the plates. Particularly, in certain embodiments, the acoustic adjuster 14 may be configured to vary the fuel system acoustic impedance of the fuel nozzles 20 between one or more combustors 12 of the system 10 by varying the geometries of the acoustic adjuster 14. In this manner, the acoustic adjuster 14 may be configured to help reduce unwanted vibratory responses in downstream components of the system 10, as further discussed with respect to FIG. 4.

Figure 2:
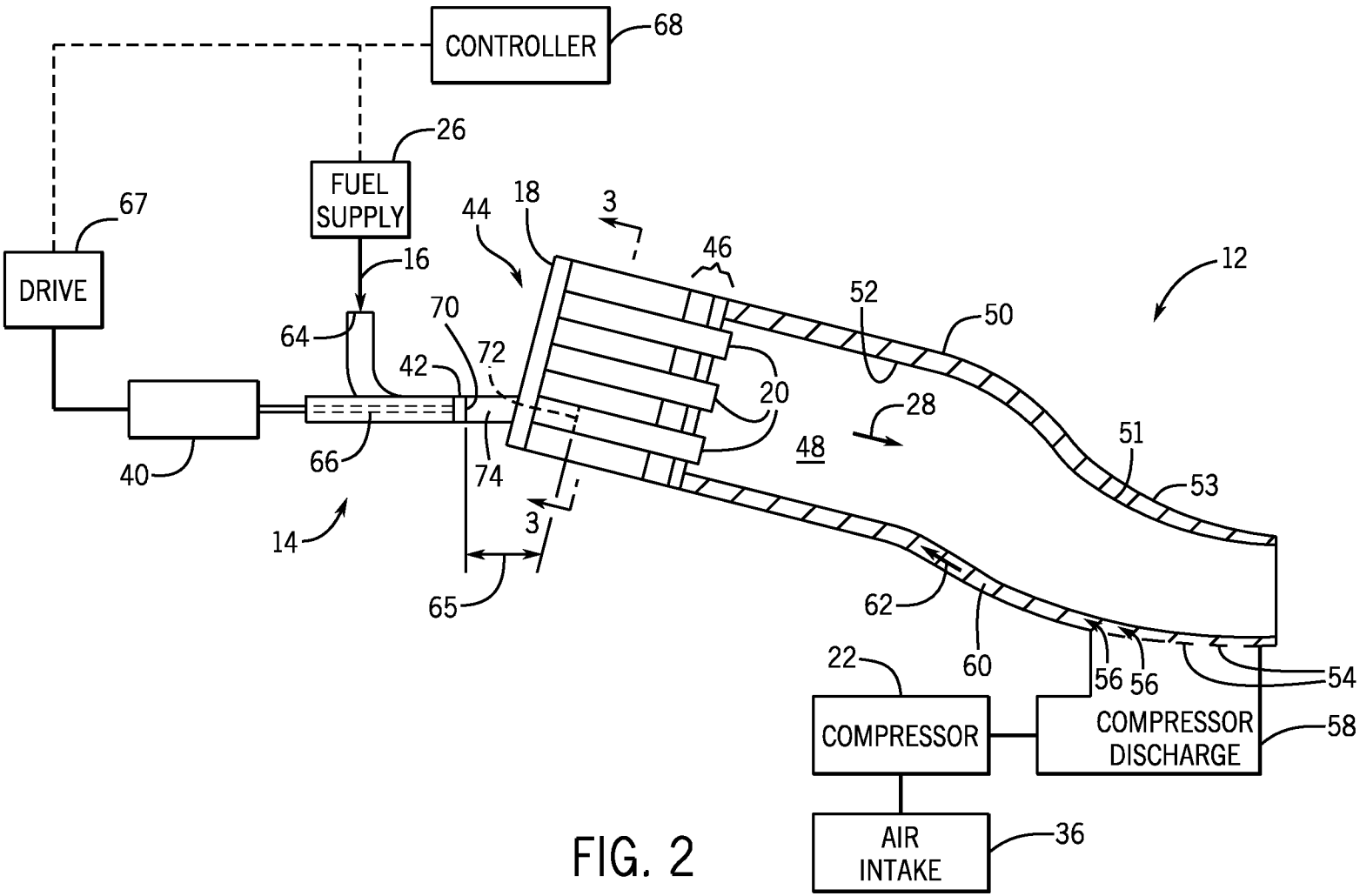
FIG. 2 is a schematic of an embodiment of one of the combustors of FIG. 1 operatively coupled to the fuel system acoustic impedance adjuster system which includes a moveable plunger system and a rotating disk system.

FIG. 2 is a schematic of an embodiment of one of the combustors 12 of FIG. 1 operatively coupled to the fuel system acoustic impedance adjuster 14 (e.g., acoustic adjuster 14), which includes a moveable plunger system 40 and a rotating disk system 42 configured to adjust the fuel system acoustic impedance (magnitude and phase) of the fuel nozzles 20. The acoustic adjuster 14 is configured to help reduce unwanted vibratory response within the gas turbine system 10 by adjusting the moveable plunger system 40 and the rotating disk system 42 (e.g., adjusting a volume between a pre-orifice and a post-orifice, adjusting a size of the pre-orifice, etc.). In the illustrated embodiment, the combustor 12 may be associated with one acoustic adjuster 14 disposed along the fuel line 16, configured to route the fuel 26 to one or more fuel nozzles 20. In other embodiments, such as within embodiments of the combustor 12 having two or more fuel lines 16, the combustor 12 may have multiple acoustic adjusters 14 (e.g., 2, 3, 4, 5, 6, or more) disposed along each fuel line 16. In yet other embodiments, each fuel nozzle 20 of the combustor 12 may be associated with 1, 2, 3, 4, 5, 6, 7, or more acoustic adjusters 14, such that the combustor 12 is associated with multiple acoustic adjusters 14 (e.g., 1, 2, 3, 4, 5, 6, or more). In particular, the geometry of the acoustic adjuster 14 may be varied to change the fuel system acoustic impedance of the associated fuel nozzles 20 leading to combustion dynamics frequencies that are different and/or phase-shifted between the fuel nozzles 20 and/or between combustors 12, thereby reducing unwanted vibratory responses in the gas turbine system 10.

The combustor 12 includes a head end 44, a combustor cap assembly 46, and a combustion chamber 48. The head end 44 of the combustor 12 generally supports and encloses fuel nozzles 20 in between the endcover 18 and the combustor cap assembly 46. The combustor cap assembly 46 generally houses the fuel nozzles 20. The fuel nozzles 20 route the fuel 26, the air, and sometimes other fluids, into the combustor chamber 48. The combustor 12 has one or more walls extending circumferentially around the combustion chamber 48, and generally represents one of a plurality of combustors 12 that are disposed in a spaced arrangement circumferentially about a rotational axis (e.g., shaft 30) of the gas turbine system 10.

In the illustrated embodiment, one or more fuel nozzles 20 are attached to the endcover 18, and pass through the combustor cap assembly 46 to the combustion chamber 48. Each fuel nozzle 20 may facilitate the mixing of pressurized air and fuel, and directs the mixture through the combustor cap assembly 46 and into the combustion chamber 48. The air-fuel mixture may then combust in the combustion chamber 48, thereby creating the hot pressurized combustion gases 28. These pressurized combustion gases 28 drive the rotation of blades within the turbine 24. Each combustor 12 includes an outer wall (e.g., flow sleeve 50) disposed circumferentially about an inner wall (e.g., combustor liner 52) to define an intermediate flow passage 60 or space, while the combustor liner 52 extends circumferentially about the combustion chamber 48. The inner wall 60 also may include a transition piece 51, which generally converges toward a first stage of the turbine 24. The impingement sleeve 53 is disposed circumferentially about the transition piece 51. The liner 52 defines an inner surface of the combustor 12, directly facing and exposed to the combustion chamber 48. The flow sleeve 50 and the impingement sleeve 53 include a plurality of perforations 54, which direct an airflow 56 from a compressor discharge 58 into the flow passage 60. The flow passage 60 then directs the airflow 62 in an upstream direction toward the head end 44 (e.g., relative to a downstream direction of the hot combustion gases 28), such that the airflow 62 further cools the liner 60, and then flows through the fuel nozzles 20, and through the combustor cap assembly 46 into the combustion chamber 48.

As noted above, the acoustic adjuster 14 includes the moveable plunger system 40 and the rotational disk 42. Further, the acoustic adjuster 14 may include a fuel inlet 64 configured to receive the fuel 26 through the fuel line 16. The fuel 26 is routed through the acoustic adjuster 14. The acoustic adjuster 14 can be used to alter the fuel system impedance (e.g. magnitude and phase). For example, in certain embodiments, the acoustic adjuster 14 may be operatively coupled to a drive 67 and/or a controller 68. The drive 67 may be configured to control the moveable plunger system 40 pneumatically, mechanically, electromechanically, hydraulically, and so forth. In some embodiments, the moveable plunger system 40 includes an actuator piston 66 that is driven by the drive 67, such that the actuator piston 66 is configured to move linearly within the acoustic adjuster 14. Adjusting the acoustic adjuster 14 with the actuator piston 66 may adjust a length 65 (e.g., distance 65) between a pre-orifice 70 and a post-orifice 72. The pre-orifice 70 may correspond to a first orifice that receives the fuel 26 from the fuel line 16. The post-orifice 72 may correspond to a second opening in the fuel nozzle 20 that routes the fuel 26 into the combustor 12, (e.g. the post-orifice 72 is the opening in the fuel nozzle 20 through which fuel is injected into the combustor 12). In certain embodiments, the post-orifice 72 may be disposed within the vane pack of the fuel nozzle 20, and the vane pack may be disposed a particular distance upstream within the fuel nozzle 20. In other embodiments, the post-orifice 72 may be disposed at the tip of the fuel nozzle 20. In particular, adjusting the distance 65 between the pre-orifice 70 and the post-orifice 72 may increase or decrease the acoustic volume of a plenum chamber 74 within the acoustic adjuster 14, thereby impacting both the phase and the magnitude of the fuel system acoustic impedance. In addition, adjusting the rotational disk system 42 may adjust the interference pattern between two or more perforated plates of the system 42, thereby altering the geometry of the pre-orifice 70, as described in detail with respect to FIGS. 5-9. For example, the rotational disk system 42 may include two parallel disks having a plurality of orifices. The two parallel disks may be rotated relative to each other to adjust the size of the orifices between the plates, or may be rotated relative to each other to adjust the interference pattern between the plates, as described in detail with respect to FIGS. 7-9.

In certain embodiments, the controller 68 (e.g., industrial controller, or any suitable computing device such as desktop computer, tablet, smart phone, etc.) may include a processor and a memory (e.g., non-transitory machine readable media) suitable for executing and storing computer instruction and/or control logic. For example, the processors may include general-purpose or application-specific microprocessors. Likewise, the memory may include volatile and/or non-volatile memory, random access memory (RAM), read only memory (ROM), flash memory, hard disk drives (HDD), removable disk drives and/or removable disks (e.g., CDs, DVDs, Blu-ray Disc™ by Sony Corp., USB pen drives, etc.), or any combination thereof. The controller 68 may be useful in automating various components of the acoustic adjuster 14, such as the moveable plunger system 40 and/or the rotational disk system 42. For example, the controller 68 may be configured to regulate the moveable plunger system 40 by controlling the drive 67.

Additionally, in certain embodiments, the turbine system 10 may include a display associated with the controller 68. In some embodiments, the display may be integrated into (e.g., mobile device screen) or separate from (e.g., distinct monitor display) the controller 68. As discussed below, the display may be used to present information to a user that enables the user to select various objectives using a graphical user interface. Additionally, the turbine system 10 may include one or more input devices that receive selections of choices from one or more users. In certain embodiments, the input devices may include mice, keyboards, touch screens, trackpads, or other input devices for receiving inputs to the controller 68. The selection of choices received from the user may include, for example, parameters of the components of the acoustic adjusters 14 (e.g., rotational disk system 42 and/or the moveable plunger system 40) that may be adjusted or controlled. For example, the user may input parameters like a degree of rotation of the rotational disk system 42, a distance 65 between the pre-orifice 70 and the post-orifice 72, a volume within the fuel plenum chamber 74 between orifices 70 and 72, and so forth. Particularly, the input parameters may be used to provide variation between the one or more acoustic adjusters 14 of the system 10, which may reduce unwanted vibratory responses resulting from combustion dynamics within the system 10.

The variability resulting from adjusting various components of the acoustic adjuster 14 may help to reduce vibratory responses in the gas turbine system 10, and minimize vibrational stress, wearing, performance degradation, or other undesirable impacts to the components of the gas turbine system 10 (e.g., turbine blades, turbine shrouds, turbine nozzles, exhaust components, combustor transition piece, combustor liner, etc.). For example, the components of the acoustic adjuster 14 (e.g., the moveable plunger system 40 and the rotational disk system 42) may be varied relative to acoustic adjusters 14 within the same combustor 12 or may be varied relative to acoustic adjusters 14 associated with other combustors 12.

Figure 3:
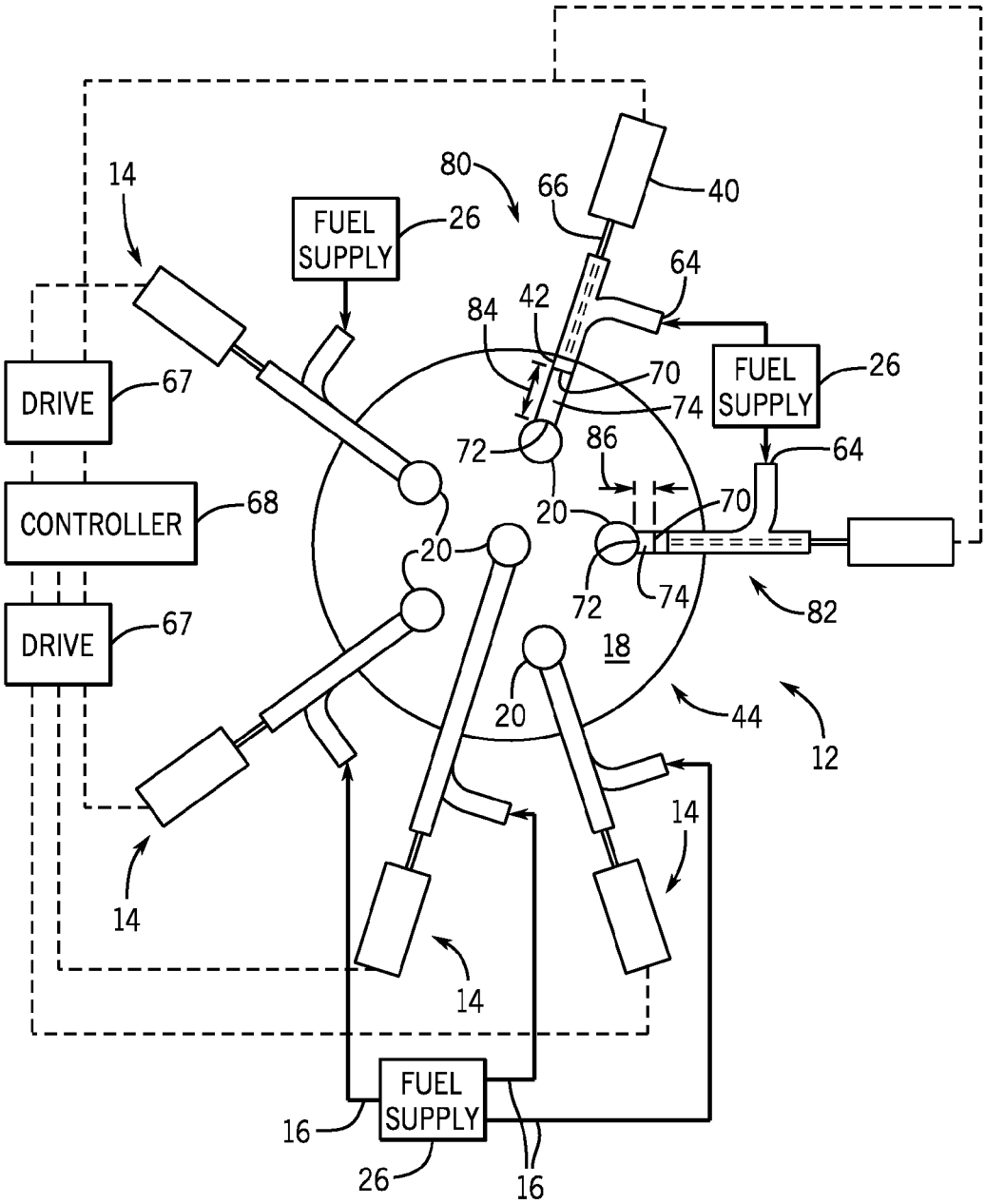
FIG. 3 is a schematic of an embodiment of the combustor of FIG. 1, illustrating a fuel system acoustic impedance adjuster operatively coupled to one or more fuel nozzles of a plurality of fuel nozzles of the combustor.

FIG. 3 is a schematic of an embodiment of the combustor 12 of FIG. 1 depicting a cross-sectional view of the head end 44 of the combustor 12, including the fuel system acoustic impedance adjuster 14 (e.g., acoustic adjuster 14) operatively coupled to each fuel nozzle 20. In the illustrated embodiment, each of the six fuel nozzles 20 are associated with corresponding acoustic adjusters 14 having the moveable plunger system 40 and the rotational disk system 42. In other embodiments, any number of fuel nozzles 20 (e.g., 1, 2, 3, 4, 5, 7, 8, 9, 10, or more) within a combustor 12 may be associated with corresponding acoustic adjusters 14. Further, the illustrated embodiment depicts three fuel lines 16 providing the fuel 26 to the fuel inlet 64 of the acoustic adjusters 14. It should be noted that in other embodiments, each fuel line 16 may be operatively coupled to a single acoustic adjuster 14 or any number of acoustic adjusters 14 (e.g., 2, 3, 4, 5, 6, 7, 8, 9, 10, or more). In addition, in certain embodiments, the acoustic adjusters 14 corresponding to the fuel nozzles 20 of the combustor 12 may be arranged and/or positioned in any combination or pattern. For example, in certain embodiments, alternating fuel nozzles 20 may be associated with the acoustic adjuster 14. In other embodiments, adjacent fuel nozzles 20 may be associated with the acoustic adjuster 14. As noted above, the geometry, physical configuration, and/or the operation of the moveable plunger system 40 and/or the rotational disk system 42 may be varied among the acoustic adjusters 14 associated with each fuel nozzle 20 and each combustor 12, thereby reducing unwanted vibratory responses resulting from combustion dynamics within the system 10 as noted above.

For example, the illustrated embodiment depicts how the geometry of the moveable plunger system 40 may be altered between a first acoustic adjuster 80 and a second acoustic adjuster 82. Specifically, the moveable plunger system 40 may be controlled or regulated by the controller 68 via the drive 67. The drive 67 may be configured to linearly adjust the actuator piston 66 of the moveable plunger system 40, such that the distance 65 between the pre-orifice 70 and the post-orifice 72 is varied for one or more fuel nozzles 20. For example, the actuator piston 66 of the first acoustic adjustor 80 may be positioned such that a first distance 84 between the pre-orifice 70 and the post-orifice 72 of the first acoustic adjuster 80 is greater than a second distance 86 between the pre-orifice 70 and the post-orifice 72 of the second acoustic adjustor 82. In this manner, the acoustic volume of the plenum chamber 74 of the first acoustic adjuster 80 is greater than the acoustic volume of the plenum chamber 74 of the second acoustic adjuster 82, thereby impacting both the phase and the magnitude of the fuel system acoustic impedance. In particular, as noted above, varying various geometries of the acoustic adjusters 14 as described above may result in changes to the fuel system acoustic impedance that may lead to reduced combustion dynamics amplitudes and/or combustion dynamics frequencies that are different within the system 10.

Figure 4:
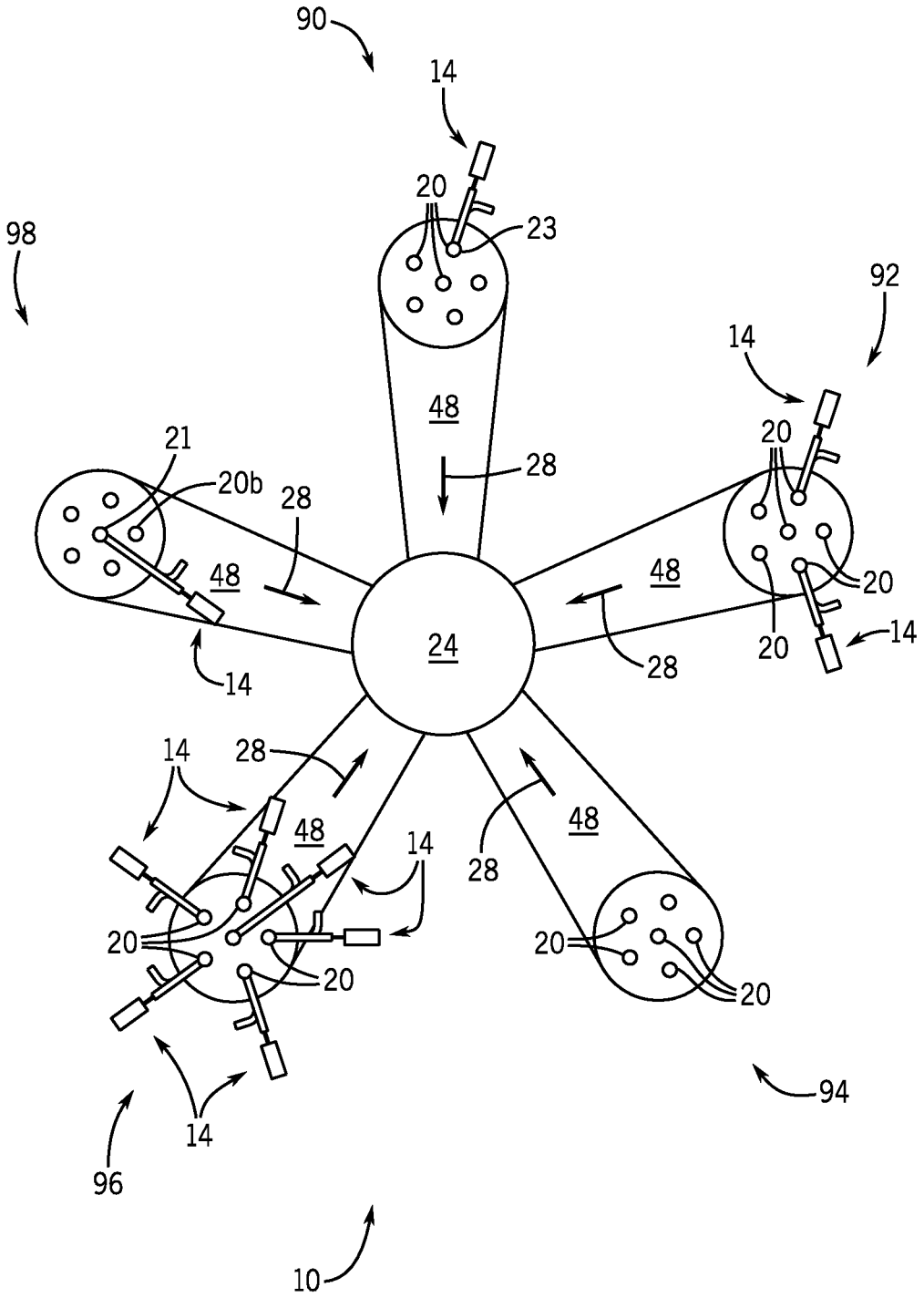
FIG. 4 is a schematic of an embodiment of the gas turbine system of FIG. 1, illustrating a plurality of combustors, one or more of which are equipped with one or more fuel system acoustic impedance adjusters configured to reduce the possibility of unwanted vibratory responses within the gas turbine system.

FIG. 4 is a schematic of an embodiment of the gas turbine of FIG. 1, illustrating a plurality of combustors 12 each equipped with the fuel system acoustic impedance adjuster 14 (e.g., acoustic adjuster 14) having the moveable plunger system 40 and the rotational disk system 42, where these components have a particular arrangement and/or position configured to help reduce unwanted vibratory responses within the system 10. In the illustrated embodiment, the gas turbine system 10 includes five combustors 12 coupled to the turbine 24. In other embodiments, the gas turbine system 10 may include any number of combustors 12, such as 1, 2, 3, 4, 6, 7, 8, 9, 10 or more combustors 12. In particular, as noted above, each combustor 12 may be associated with any number of acoustic adjusters 14, such as 1, 2, 3, 4, 5, 6, 7, 8, 9, 10 or more acoustic adjusters 14, in any pattern, position, or configuration. Accordingly, as noted above, varying the geometries of the acoustic adjusters 14 may result in changes to the fuel system acoustic impedance that may alter the combustion dynamics frequencies (particularly in at least one combustor 12 compared to the other combustors 12), combustion dynamics amplitudes, combustor-to-combustor phase among the combustors 12 and/or that may reduce modal coupling of the combustion dynamics among the plurality of combustors 12.

The illustrated embodiment of the gas turbine system 10 depicts various configurations, patterns, or positions of the acoustic adjusters 14 within each combustor 12 and between combustors 12. For example, a first combustor 90 includes a single acoustic adjuster 14 coupled to the fuel nozzle 20, while a second combustor 92 adjacent to the first combustor 90 includes two acoustic adjusters 14 coupled to the fuel nozzles 20. Accordingly, the acoustic adjusters 14 may vary the fuel system impedance between the first combustor 90 and the second combustor 92. In certain embodiments, various other configurations, patterns, or positions of the acoustic adjuster 14 may be used. For example, a third combustor 94 may be configured without any acoustic adjuster 14, while a fourth combustor 96 may be configured with one or more acoustic adjusters 14. In certain embodiments, a fifth combustor 98 may be configured with the same number of acoustic adjusters 14 as an adjacent combustor 12 (e.g., the first combustor 90), but which may be positioned in a different arrangement, configuration, and/or position. For example, the fifth combustor 98 may include one acoustic adjuster 14 positioned on a central fuel nozzle 21, as opposed to the acoustic adjuster 14 of the first combustor 90 which is positioned on a perimeter fuel nozzle 23. As noted above, each combustor 12 may include 0, 1, 2, 3, 4, 5, 6, 7, 8, 9, 10 or more acoustic adjusters 14 on the same or different fuel nozzles (e.g., in a particular arrangement).

In some embodiments, the system 10 may include one or more groups (e.g., 1, 2, 3, 4, 5, or more) of combustors 12, where each group of combustors 12 includes one or more combustors 12 (e.g., 1, 2, 3, 4, 5, or more). In some situations, each group of combustors 12 may include one or more identical combustors 12 that differ from one or more other groups of combustors 12 within the system 10. For example, a first group of combustors 12 may include identical combustors 12 having a particular acoustic adjuster 14 configuration, and a second group of combustors 12 may include identical combustors 12 have a second acoustic adjuster 14 configuration. Further, the first and second acoustic adjusters 14 may be different in one or more ways, as described above. Accordingly, the first group of combustors 12 may produce a fuel system acoustic impedance that is different from the fuel system acoustic impedance of the second group of combustors 12 within the system 10, as further explained below.

As a further example, in certain embodiments, a first group of combustors 12 may include identical combustors 12 each having a first acoustic adjuster 14 geometry, a second group of combustors 12 may include identical combustors 12 each having a second acoustic adjuster 14 geometry, and a third group of combustors 12 may include identical combustors 12 each having a third acoustic adjuster 14 geometry. Further, the acoustic adjuster 14 geometries of each group of combustors may be different from each other in one or more ways, as described with respect to FIGS. 1-6. Accordingly, the acoustic adjusters 14 of the first group of combustors 12 may be adjusted and/or tuned to achieve a first fuel system acoustic impedance, the acoustic adjusters 14 of the second group of the combustors 12 may be adjusted and/or tuned to a configuration different from the first group of combustors to achieve a second fuel system acoustic impedance, and the acoustic adjusters 14 of the third group of the combustors 12 may be adjusted and/or tuned different form the first and/or second group of combustors to achieve a third fuel system acoustic impedance. The first, second, and third fuel system acoustic impedances may be different from one another. As a result, varying the geometries of the acoustic adjusters 14 may result in changes to the fuel system acoustic impedance that may alter the combustion dynamics frequencies (particularly in at least one combustor 12 compared to the other combustors 12), the combustion dynamics amplitudes, the combustor-to-combustor phase among the combustors 12 and/or that may reduce modal coupling of the combustion dynamics among the plurality of combustors 12. Although three groups and three frequencies are described, it should be clear that any number of groups and/or frequencies may be employed. It should also be clear that not all combustors are required to have acoustic adjusters 14. One or more combustors 12 or groups of combustors 12 may not have any acoustic adjusters 14.

Figure 5:
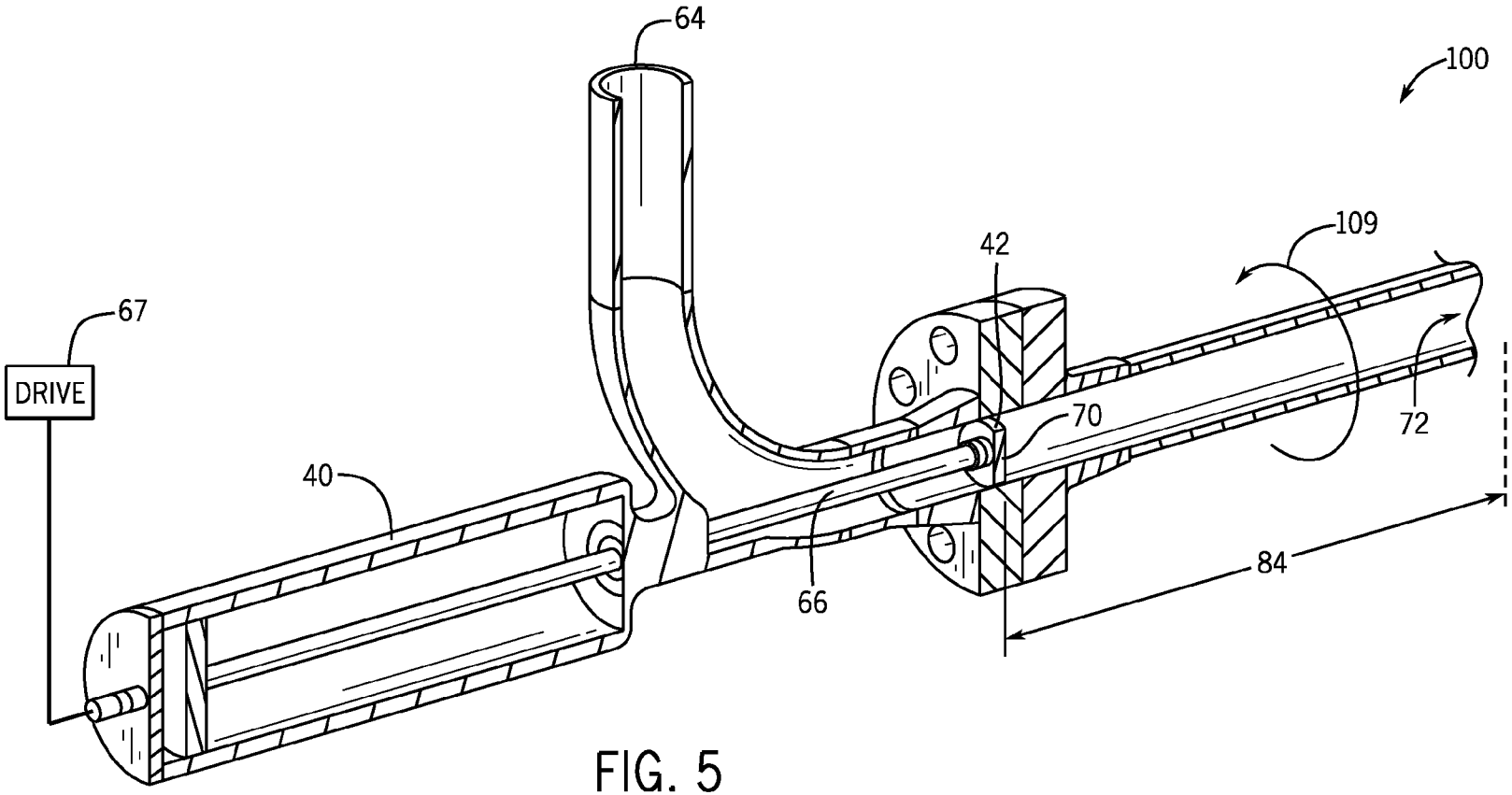
FIG. 5 and FIG. 6 are partial cutaway views of an embodiment of the fuel system acoustic impedance adjuster of FIGS. 1-4, illustrating an adjustment between first and second distances between a pre-orifice and a post-orifice via the movable plunger system.
Figure 6:
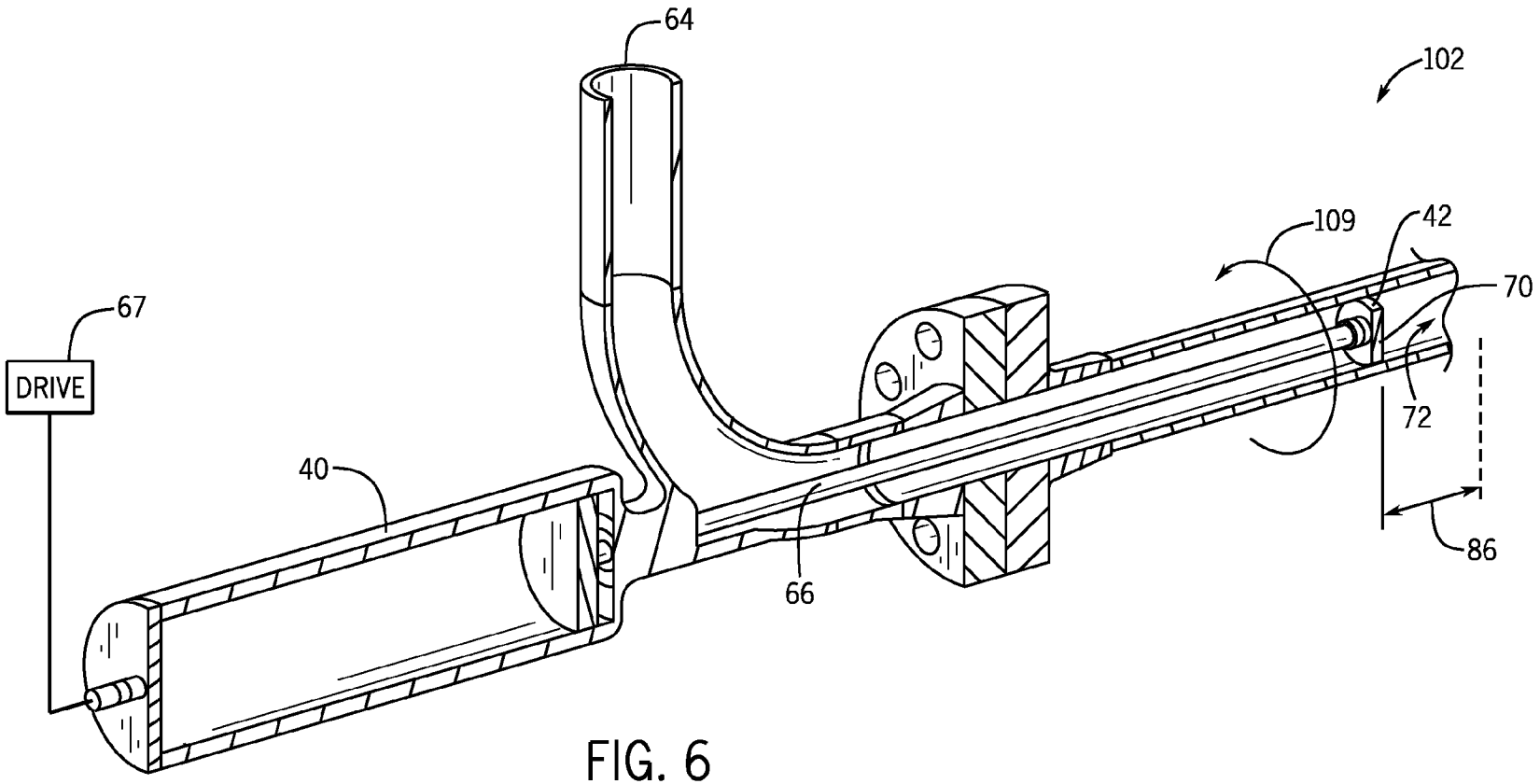

FIG. 5 and FIG. 6 are schematic cross-sectional views of an embodiment of the fuel system acoustic impedance adjuster 14 (e.g., the acoustic adjuster 14) of FIGS. 1-4, illustrating a first distance 84 between the pre-orifice 70 and the post-orifice 72 in a first configuration 100 of FIG. 5, and a second distance 86 between the pre-orifice 70 and the post-orifice 72 in a second configuration 102 of FIG. 6. In particular, the acoustic adjuster 14 includes the moveable plunger system 40 and the rotational disk system 42. Further, the acoustic adjuster 14 includes the fuel inlet 64 and routes a fuel from the fuel supply 26 to the combustion chambers 48 via one or more fuel nozzles 20. Specifically, the rotational disk system 42 includes a plurality of perforated plates, such as a first plate 104, a second plate 106, and a central plate 107 separating the first plate 104 from the second plate 106, as further described with respect to FIG. 7. In certain embodiments, the central plate 107 may be coupled to the actuator piston 66, and may be configured to provide rotary motion 109 to the rotational disk system 42.

As noted above, the drive 67 may be configured to operate the acoustic adjuster 14 in response to control signals (e.g., command signals) received by the controller 68. Particularly, as noted above, the drive 67 may control the actuator piston 66 so that it actuates linearly to provide axial motion that increases or decreases the distance 65 (as shown in FIG. 2) between the pre-orifice 70 and the post-orifice 72. In particular, the actuator piston 66 may be configured to position the acoustic adjustors 14 into a plurality of axial positions. Further, the drive 67 may be configured to control the actuator piston 66 to provide rotary motion 109 that rotates the central plate 107 to vary the interference pattern of the orifices 108, as discussed further with respect to FIGS. 7-9.

Figure 7:
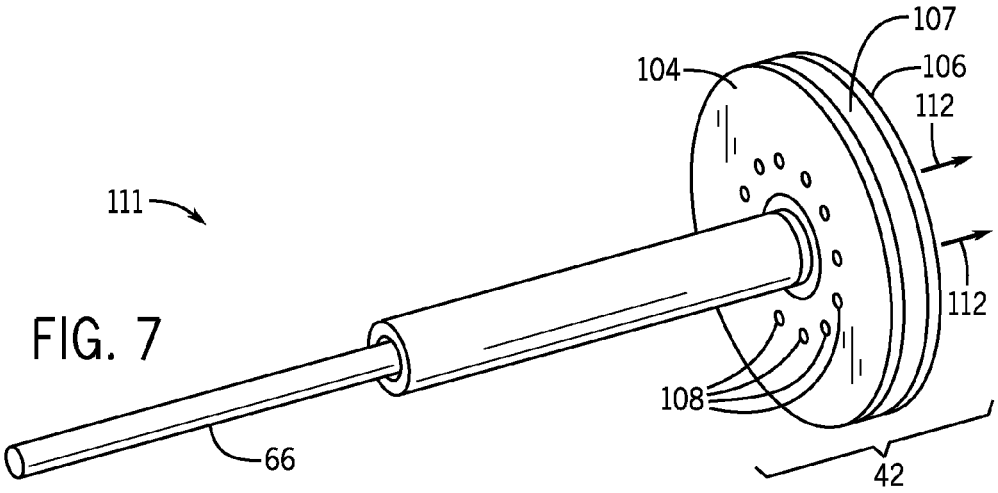
FIG. 7 is a perspective view of an embodiment of the fuel system acoustic impedance adjuster of FIGS. 1-6, illustrating the rotational disk system coupled to an actuator piston.

FIG. 7 is an embodiment 111 of the acoustic adjuster 14 illustrating the rotational disk system 42 coupled to the actuator piston 66. In particular, the actuator piston 66 is configured to provide rotary motion 109 to the central plate 107 of the rotational disk system 42 to change the interference pattern of the one or more orifices 108 between the first plate 104 and the second plate 106. Changing the interference pattern of the one or more orifices 108 between the first plate 104 and the second plate 106 may change the acoustic impedance of the fuel system. In addition, changing the interference pattern of the one or more orifices 108 between the first plate 104 and the second plate 106 may change the pressure ratio across the rotating disk system (and therefore the fuel nozzle pressure ratio), and in some embodiments, may also change the mass flow through the rotating disk system, which in turn, changes the mass flow through the fuel nozzle 20. Altering the mass flow through the fuel nozzle may also alter the equivalence ratio of the fuel nozzle 20, and/or the flame shape. As noted above, changing the acoustic impedance may alter the combustion dynamics within the combustor 12 and reduce unwanted vibratory responses. In addition, altering the pressure ratio across the fuel nozzle, the equivalence ratio and/or the flame shape may also alter the combustion dynamics within the combustor 12 and reduce unwanted vibratory responses.

For example, the first plate 104 and the second plate 106 are stationary plates having orifices 108 that are identically positioned or arranged such that one or more channels 110 (depicted in FIGS. 8 and 9) are provided through the rotational disk system 42 when the orifices 108 are aligned with one another. In the illustrated embodiment, each perforated plate, such as the first perforated plate 104, the second perforated plate 106, or the central perforated plate 107, includes a plurality of orifices 108 through which the fuel (e.g., from the fuel supply 26) flows as it is delivered to the combustor 12. In the illustrated embodiment, the orifices 108 are arranged concentrically around the perimeter of the rotational disk system 42 and have the same shape and size (e.g., circular orifices 108 with identical radius, diameter, circumference, etc.). In other embodiments, the orifices 108 may be any shape (e.g., elliptical, triangular, rectangular, pentagonal, octagonal, hexagonal, etc.) or generally may be any type of opening (e.g., slits, cuts, apertures, slots, and/or gaps). Further, the orifices 108 may be any size, and may generally be positioned in a variety of configurations and/or patterns (e.g., random, rows, columns, arrays, lines, curved lines, waves, grid, swirls, etc.) on each plate of the rotational disk system 42. Particularly, the arrangement of the orifices 108 may be the same on the first disk 104, the second disk 106, and the central disk 107, such that orifices 108 provide one or more channels 110 (depicted in FIGS. 8 and 9) through the rotational disk system 42 when the orifices 108 are aligned.

In some embodiments, the fuel (e.g., from the fuel supply 26) received at the fuel inlet 64 of the acoustic adjuster 14 is routed through the channels 110 of the rotational disk system 42 (e.g., the fuel flow 112). Further, the central plate 107 may be a rotating plate coupled to the actuator piston 66. The central plate 107 may include orifices 108 that are positioned or arranged such that the cross-sectional area of the one or more channels 110 is at a maximum when the orifices 108 are aligned with the orifices 108 of the first plate 104 and the second plate 106. In certain embodiments, the central plate 107 may be rotated such that the orifices 108 of the central plate 107 are off-set relative to the orifices 108 of the first plate 104 and the second plate 106. In such embodiments, the off-set (e.g., misalignment) of the orifices 108 may be directly correlated with the angle of rotation of the central plate 107 and the actuator piston 66. The actuator piston 66 may be rotated at approximately any angle (e.g., 1-10 degrees, 1-20 degrees, 1-30 degrees, etc.) or at approximately any fraction of an angle (e.g., 0.1 degrees, 0.2 degrees, 0.3 degrees, 0.4 degrees, 0.5 degrees, etc.) to increase or decrease the cross-sectional area of the channels 110. As noted above, the orifices 108 may be any size or shape, and further may be arranged in any geometric configuration, pattern, or arrangement. In particular, variations in the orifices 108 may vary the acoustic impedance of the fuel plenum, and/or the mass flow through the fuel nozzle 20.

In particular, it should be noted that a variety of parameters relating to the rotational disk system 42 may be changed so that the fuel system acoustic impedance and/or mass flow of the fuel 112 between acoustic adjusters 14 are varied. For example, rotating the central plate 107 such that the orifices 108 of the central plate 107 are offset from the orifices 108 of the first plate 104 and the second plate 106 varies the interference pattern between the first plate 104 and the second plate 106. In particular, the interference pattern may be varied between two or more acoustic adjusters 14, such that the interference pattern and fuel flow 112 may be varied within a particular combustor 12 (e.g., between the fuel nozzles 20 of a single combustor 12) or between two or more combustors 12 (e.g., between fuel nozzles 20 of two or more combustors 12). In other embodiments, geometric characteristics of the orifices 108 (e.g., size, shape, arrangement, etc.) may be varied between acoustic adjusters 14, such that the fuel system acoustic impedance is varied within a particular combustor 12 (e.g., between the fuel nozzles 20 of a single combustor 12) or between two or more combustors 12 (e.g., between fuel nozzles 20 of two or more combustors 12).

Figure 8:
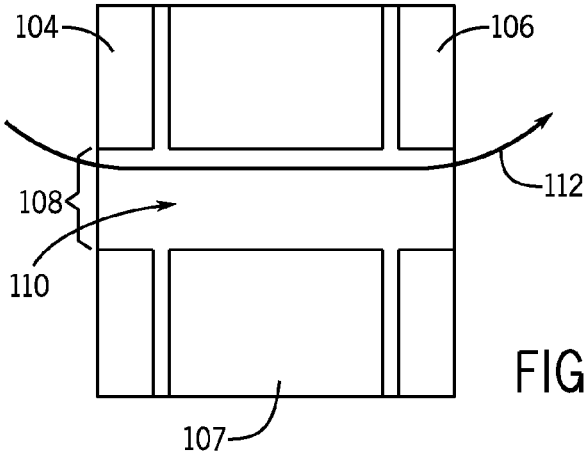
FIG. 8 is a schematic side view of an embodiment of the rotational disk system of FIG. 7, illustrating a maximum fuel flow through a channel of the rotational disk system.

FIG. 8 is a schematic cross-sectional view of an embodiment of the rotational disk system 42 depicting the channel 110, where the fuel flow 112 through the channel 110 is at a maximum. In the illustrated embodiment, the central plate 107 is positioned such that the orifices 108 of the central plate 107 is aligned between the orifices 108 of the first plate 104 and the second plate 106. In such embodiments, the channel 110 provides a maximum cross-sectional area through which the fuel flow 112 passes.

Figure 9:
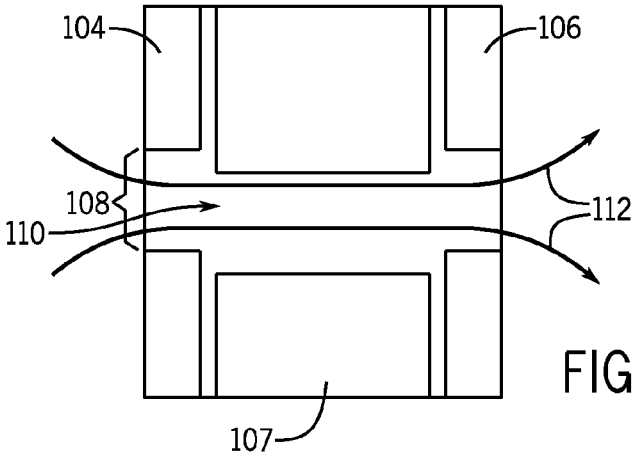
FIG. 9 is a schematic side view of an embodiment of the rotational disk system of FIG. 7, illustrating a fuel flow through the channel of the rotational disk system.

FIG. 9 is a schematic cross-sectional view an embodiment of the rotational disk system 42 depicting the channel 110, where the central plate 107 is rotated to decrease the fuel flow 112 through the channel 110. In the illustrated embodiment, the central plate 107 is positioned such that the orifices 108 of the central plate 107 are offset or misaligned relative to the orifices 108 of the first plate 104 and the second plate 106. In such embodiments, the channel 110 provides a decreased amount of fuel flow 112 relative the embodiments of FIG. 7.

Technical effects of the invention include reducing unwanted vibratory responses associated with combustion dynamics by providing one or more fuel system acoustic impedance adjusters 14 (e.g., acoustic adjuster 14) configured to adjust the fuel system acoustic impedance (magnitude and phase) of the fuel nozzles 20, and/or the fuel flow through the fuel nozzles 20. The acoustic adjuster 12 includes the movable plunger system 40 and the rotational disk system 42 configured to adjust the vibratory response of the gas turbine system 10. For example, the movable plunger system 40 may be driven by any type of actuator (e.g., pneumatic, electrometrical, hydraulic, etc.) to generate axial motion which may increase or decrease the distance 65 (and thus the acoustic volume of the fuel plenum) between the pre-orifice 70 and the post-orifice 72. Further, the rotational disk system 42 may be driven to generate rotary motion 109 which may change the interference pattern between the orifices 108 of the rotational disk system 42. Changing the interference pattern between the orifices 108 may increase or decrease the size of the channels 110, and may vary the fuel system acoustic impedance characteristics of the fuel nozzles 20 and/or the fuel flow 112 through the fuel nozzles 20 routing the fuel to the combustor 12.

In particular, the geometries of the acoustic adjuster 14 may be varied within a particular combustor 12 and/or between two or more combustors 12 of the system 10. For example, each combustor 12 may be associated with one or more acoustic adjusters 14 that are each coupled to one or more fuel nozzles 20. Further, the pattern of the acoustic adjusters 14 coupled to the fuel nozzles 20 may vary between the combustors 12 of the system 10. In this manner, unwanted vibratory responses within the system 10 may be reduced. Particularly, reducing unwanted responses may reduce vibrational stress, structural vibrations, wearing, mechanical fatigue, thermal fatigue, performance degradations, or other undesirable impacts to the components of the system 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a gas turbine engine, comprising:

a first combustor comprising a first fuel nozzle;

a second combustor comprising a second fuel nozzle;

a first acoustic adjuster having a first drive coupled to a first piston with a first fuel orifice, wherein the first piston is disposed along a first fuel passage leading to the first fuel nozzle, and wherein the first drive is coupled to a first rotational disk system having a first plurality of perforated discs; and a second acoustic adjuster having a second drive coupled to a second piston with a second fuel orifice, wherein the second piston is disposed along a second fuel passage leading to the second fuel nozzle, and wherein the second drive is coupled to a second rotational disk system having a second plurality of perforated disks.

2. The system of claim 1, wherein the gas turbine engine comprises a controller configured to control the first drive or the second drive to vary a fuel system acoustic impedance of the first fuel nozzle or the second fuel nozzle.

3. The system of claim 1, wherein the first drive of the first acoustic adjuster is configured to adjust a first axial position of the first piston to vary a first distance between the first fuel orifice and the first fuel nozzle.

4. The system of claim 3, wherein the second drive of the second acoustic adjuster is configured to adjust a second axial position of the second piston to vary a second distance between the second fuel orifice and the second fuel nozzle, wherein the first distance is different from the second distance.

5. The system of claim 4, wherein the first axial position of the first piston corresponds to a first acoustic volume between the first fuel orifice and a first post-orifice along the first fuel passage, and the second axial position of the second piston corresponds to a second acoustic volume between the second fuel orifice and a second post-orifice along the second fuel passage, and wherein the first acoustic volume is different than the second acoustic volume.

6. A system, comprising:

a first combustor, comprising:

a first fuel nozzle comprising a first fuel post-orifice;

a second fuel nozzle comprising a second fuel post-orifice;

a first acoustic adjuster having a first drive coupled to a first piston with a first fuel pre-orifice, wherein the first piston is disposed along a first fuel passage leading to the first fuel post-orifice, wherein the first piston is coupled to a first rotational disk system comprising a first plurality of perforated plates, and wherein the first drive is configured to adjust a first rotational position of a first plate of the first plurality of perforated plates to form a first interference pattern in orifices between the first plurality of perforated plates; and a second acoustic adjuster having a second drive coupled to a second piston with a second fuel pre-orifice, wherein the second piston is disposed along a second fuel passage leading to the second fuel post-orifice.

7. The system of claim 6, wherein a gas turbine engine comprises a controller configured to control the first drive or the second drive to vary a fuel system acoustic impedance of the first fuel nozzle or the second fuel nozzle.

8. The system of claim 6, wherein the second piston is coupled to a second rotational disk system comprising a second plurality of perforated plates, and wherein the second drive is configured to adjust a second rotational position of a second plate of the second plurality of perforated plates to form a second interference pattern in the orifices between the second plurality of perforated plates.

9. The system of claim 8, wherein the first and second drives are configured to selectively change the first and second interference patterns to be different from one another.

10. The system of claim 9, wherein the first interference pattern corresponds to a first fuel system acoustic impedance characteristic of the first fuel nozzle, and the second interference pattern corresponds to a second fuel system acoustic impedance characteristic of the second fuel nozzle, and wherein the first fuel system acoustic impedance characteristic is different from a second fuel system acoustic impedance characteristic.

11. The system of claim 10, wherein the first and second fuel system acoustic impedance characteristics comprises a phase or a magnitude.

12. The system of claim 6, comprising at least one controller coupled to the first drive and the second drive.

13. The system of claim 6, wherein the first drive of the first acoustic adjuster is configured to adjust a first axial position of the first piston, and the second drive of the second acoustic adjuster is configured to adjust a second axial position of the second piston.

14. The system of claim 13, wherein the first axial position of the first piston corresponds to a first acoustic volume between the first fuel pre-orifice and the first post-orifice along the first fuel passage, and the second axial position of the second piston corresponds to a second acoustic volume between the second fuel pre-orifice and the second post-orifice along the second fuel passage, and wherein the first acoustic volume is different from the second acoustic volume.

15. A system, comprising:

a gas turbine engine, comprising:

a first fuel nozzle comprising a first fuel post-orifice;

a first acoustic adjuster having a first drive coupled to a first piston with a first fuel pre-orifice, wherein the first piston is disposed along a first fuel passage leading to the first fuel post-orifice of the first fuel nozzle, and wherein the first piston is coupled to a first rotational disk system, wherein the first rotational disk system comprises:

a first plate and a second plate;

a central plate disposed in between the first plate and the second plate; and a plurality of orifices disposed on the first plate, the second plate, and the central plate, wherein the plurality of orifices create a plurality of channels passing through the first rotational disk system.

16. The system of claim 15, wherein the first drive of the first acoustic adjuster is configured to adjust a first rotational position of the central plate to adjust an interference pattern of the plurality of orifices between the first plate and the second plate, and wherein adjusting the interference pattern comprises adjusting a cross-sectional area of each channel within the plurality of channels passing through the first rotational disk system.

17. The system of claim 15, wherein the first drive of the first acoustic adjuster is configured to adjust a first axial position of the first piston to vary a first distance between the first fuel pre-orifice and the first fuel post-orifice.

* * * * *